US008353327B2

(12) United States Patent
Domingue et al.

(10) Patent No.: US 8,353,327 B2
(45) Date of Patent: Jan. 15, 2013

(54) ADJUSTABLE CANVAS STRETCHING ASSEMBLY HAVING ADJUSTABLE STRETCHING BARS

(76) Inventors: Suzanne Domingue, Ste-Thérèse (CA); Charles Le Borgne, Ste-Thérèse (CA)

( * ) Notice: Subject to any disclaimer, the term of this patent is extended or adjusted under 35 U.S.C. 154(b) by 5 days.

(21) Appl. No.: 12/929,936

(22) Filed: Feb. 25, 2011

(65) Prior Publication Data

US 2011/0203753 A1 Aug. 25, 2011

Related U.S. Application Data

(60) Provisional application No. 61/282,531, filed on Feb. 25, 2010.

(51) Int. Cl.
*E06B 3/30* (2006.01)

(52) U.S. Cl. ..... 160/374.1; 160/378; 160/371; 160/379; 38/102.1

(58) Field of Classification Search ..... 160/374.1, 160/378, 369, 371–374, 379, 380, 381, 273.1; 38/102.1, 102.5, 102.91, 102.2, 102.4, 102.7; 52/656.1, 656.7
See application file for complete search history.

(56) References Cited

U.S. PATENT DOCUMENTS

| | | | | |
|---|---|---|---|---|
| 376,881 | A * | 1/1888 | Haish | 160/381 |
| 1,573,562 | A * | 2/1926 | Miersma | 38/102.5 |
| 3,625,274 | A | 12/1971 | Johnson | |
| 4,050,498 | A | 9/1977 | Lucchetti | |
| 4,144,660 | A * | 3/1979 | Lamb | 38/102.5 |
| 4,179,830 | A * | 12/1979 | Lamb | 38/102.5 |
| 4,707,204 | A * | 11/1987 | Heeg | 156/91 |
| 5,143,138 | A * | 9/1992 | Zwart | 160/395 |
| 5,261,203 | A * | 11/1993 | Yoon | 52/455 |
| 5,351,459 | A * | 10/1994 | Kassl et al. | 52/656.5 |
| 6,253,471 | B1 * | 7/2001 | Strauh | 38/102.1 |
| 6,422,292 | B1 * | 7/2002 | Berry et al. | 160/374.1 |
| 6,863,112 | B1 * | 3/2005 | Ayers et al. | 160/371 |
| 7,698,871 | B2 * | 4/2010 | Mansueto et al. | 52/656.9 |
| 7,735,541 | B2 * | 6/2010 | Ocampo | 160/374 |
| 2005/0006038 | A1 * | 1/2005 | Armstrong | 160/371 |
| 2008/0159806 | A1 * | 7/2008 | Niswonger | 403/231 |
| 2008/0289780 | A1 * | 11/2008 | McGregor et al. | 160/371 |

* cited by examiner

*Primary Examiner* — Katherine W Mitchell
*Assistant Examiner* — Johnnie A Shablack
(74) *Attorney, Agent, or Firm* — Equinox Protection; Franz Bonsang

(57) ABSTRACT

A canvas stretching assembly has adjustable stretching bars connecting in an end-to-end configuration that allow for the stretching of a canvas, even after the canvas is mounted thereon, with the degree of stretching being adjustable in multiple directions. The canvas stretching assembly, when disassembled, may be compactly stored, which is especially appreciated for shipment purposes.

11 Claims, 5 Drawing Sheets

ADJUSTABLE CANVAS STRETCHING ASSEMBLY HAVING ADJUSTABLE STRETCHING BARS

CROSS REFERENCE TO RELATED APPLICATIONS

Benefit of U.S. Provisional Application for Patent Ser. No. 61/282,531 filed on Feb. 25, 2010, which is incorporated herein by reference, is hereby claimed.

FIELD OF THE INVENTION

The present invention relates to canvas stretching apparatuses and assemblies for stretching canvases, and is more particularly directed to an adjustable canvas stretching assembly having adjustable stretching bars.

BACKGROUND OF THE INVENTION

Use of stretched canvas as a preferred medium for painting is well known in the art. However, traditional methods, apparatuses, and assemblies for stretching the canvas to a desired tightness, whether before or after painting or other inscription of an image thereupon, often require specialized tools and skills, and therefor specialized personnel. Accordingly, proper stretching of the canvas to a desired tightness can be both time consuming and expensive.

For example, purchasers of (unframed) canvases having artwork inscribed thereon are often obligated to retain professional framing services to stretch the canvas to the desired tightness on a frame base or stretching assembly having stretching members or bars, which may themselves form a frame base. Subsequently, the canvas may be hung on a wall or other structure by hanging the frame base or stretching assembly with the stretched canvas thereupon. Alternatively, once the canvas is stretched on the assembly, a decorative frame moulding may be connected or mounted on the assembly to provide a desired aesthetic effect. In either case, the canvas must be transported to the framing service, stretched and framed, and then transported back to the purchaser on the frame base. Obviously, this process, in addition to the cost of the stretching and framing, involves the cost, and time, of transport of the canvas to the framing service and of the canvas on the frame base back to the purchaser. These costs can be prohibitive, especially for larger canvases and/or for situations where the framing service is situated at long distance from the purchaser.

Accordingly, there is a need for an improved canvas stretching assembly.

SUMMARY OF THE INVENTION

It is therefore a general object of the present invention to provide an improved canvas stretching assembly for a canvas.

An advantage of the present invention is that the degree of stretching of the canvas is adjustable, even after the canvas is mounted thereon.

Another advantage of the present invention is that the degree of stretching is adjustable in multiple directions.

Still another advantage of the present invention is that the canvas stretching assembly is of simple construction.

Yet another advantage of the present invention is that the canvas stretching assembly, when disassembled, may be compactly stored, which is especially appreciated for shipment purposes.

Still a further advantage is that the canvas may be stretched using the canvas stretching assembly without special skills or recourse to specialized tools.

As yet another advantage, the stretching assembly may be used, once the canvas is stretched thereupon, as a frame base to hang the canvas, with optional attachment of decorative mouldings to form a decorative frame.

In one aspect, the present invention provides an adjustable canvas stretching assembly for stretching a canvas, the stretching assembly comprising:

first, second, third, and fourth elongate stretching bars of generally rectangular hexahedron shape having, extending longitudinally from respective first end faces to opposed respective second end faces, opposed respective outer and inner faces extending adjacently between generally opposed rear and front faces, each first end face having at least one end channel extending axially from the first end face inwardly into the stretching bar along an axis defined by the stretching bar and an adjustable bolt disposed thereon and axially adjustable rear and forth along the axis by rotation of the bolt, each inner face having at least one inner channel extending inwardly into the stretching bar from the inner face and generally perpendicular the axis adjacent the respective second end face, the first and second stretching bars being of a first length and the third and fourth stretching bars being of a second length; and a plurality of connector members, each connector member being snugly insertable into an inner channel of one stretching bar and into the end channel of an adjacent stretching bar to connect, in an assembled configuration for the assembly, the first and second stretching bars generally perpendicularly to the third and fourth stretching bars with each first end face of each stretching bar connected to the inner face of an adjacent stretching bar and abutting against a head of the bolt, with the front bar faces defining a front side of the assembly and the rear faces defining a rear side of the assembly for attachment of the canvas thereto, the end channels and inner channels being positioned for registration of the second end face of each stretching bar with the outer face of an adjacent stretching bar connected thereto, wherein the stretching bars may be drawn away from one another when connected by rotating the bolts to stretch the canvas tightly across the front side of the assembly.

Preferably, each first end face has two end channels and each inner face has two corresponding inner channels.

In one embodiment, each rear face has a slot extending inwardly therefrom and oriented generally axially therealong, and, for each stretching bar, the assembly includes a corresponding slot member, each slot and corresponding slot member being sized and shaped for snug and retaining insertion of the corresponding slot member into the slot, for gripping the canvas therebetween.

Conveniently, each slot extends axially between the first and second end faces of the corresponding stretching bar.

In one embodiment, the assembly further includes an elongate cross bar extending between the first and second stretching bars and having a length substantially equal to the second length, the cross bar having at least one cross bar channel extending generally axially therein at each one of opposed cross bar ends and connector members, each connector member being snugly insertable into a corresponding one of the cross bar channel and into a corresponding frame cross bar channel extending inwardly from the inner face of a corresponding one of the first and second stretching bars and being disposed generally centrally thereupon to connect, in the assembled configuration, the cross bar generally perpendicularly to the first and second stretching bars.

Typically, each one of the cross bar end includes a corresponding adjustable cross bar bolt disposed thereon and axially adjustable rear and forth along a cross bar axis by rotation of the cross bar bolt, in the assembled configuration, the cross bar connecting to the first and second stretching bars with the inner face of each one of the first and second stretching bars connecting to a corresponding cross bar end and abutting against a head of the cross bar bolt.

Conveniently, the cross bar is a first cross bar, and the assembly further includes a second elongate cross bar extending between the third and fourth stretching bars and having a length substantially equal to the first length, the second cross bar having at least one cross bar channel extending generally axially therein at each one of opposed cross bar ends and connector members, each connector member being snugly insertable into a corresponding one of the cross bar channel and into a corresponding frame cross bar channel extending inwardly from the inner face of a corresponding one of the third and fourth stretching bars and being disposed generally centrally thereupon to connect, in the assembled configuration, the second cross bar generally perpendicularly to the third and fourth stretching bars.

Typically, each one of the second cross bar end includes a corresponding adjustable cross bar bolt disposed thereon and axially adjustable rear and forth along a cross bar axis by rotation of the cross bar bolt, in the assembled configuration, the second cross bar connecting to the third and fourth stretching bars with the inner face of each one of the third and fourth stretching bars connecting to a corresponding second cross bar end and abutting against a head of the cross bar bolt.

Typically, each one of the first and second cross bars has a generally centrally recess formed thereon for receiving an intersecting section of the other one of the first and second cross bars at an intersection thereof when in the assembled configuration.

Conveniently, each one of the cross bar bolt has a perforating protrusion extending axially from the head of the cross bar bolt.

In one embodiment, the first and second lengths are substantially equal to one another.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENT

With reference to the annexed drawings the preferred embodiments of the present invention will be herein described for indicative purpose and by no means as of limitation.

Figure 1:
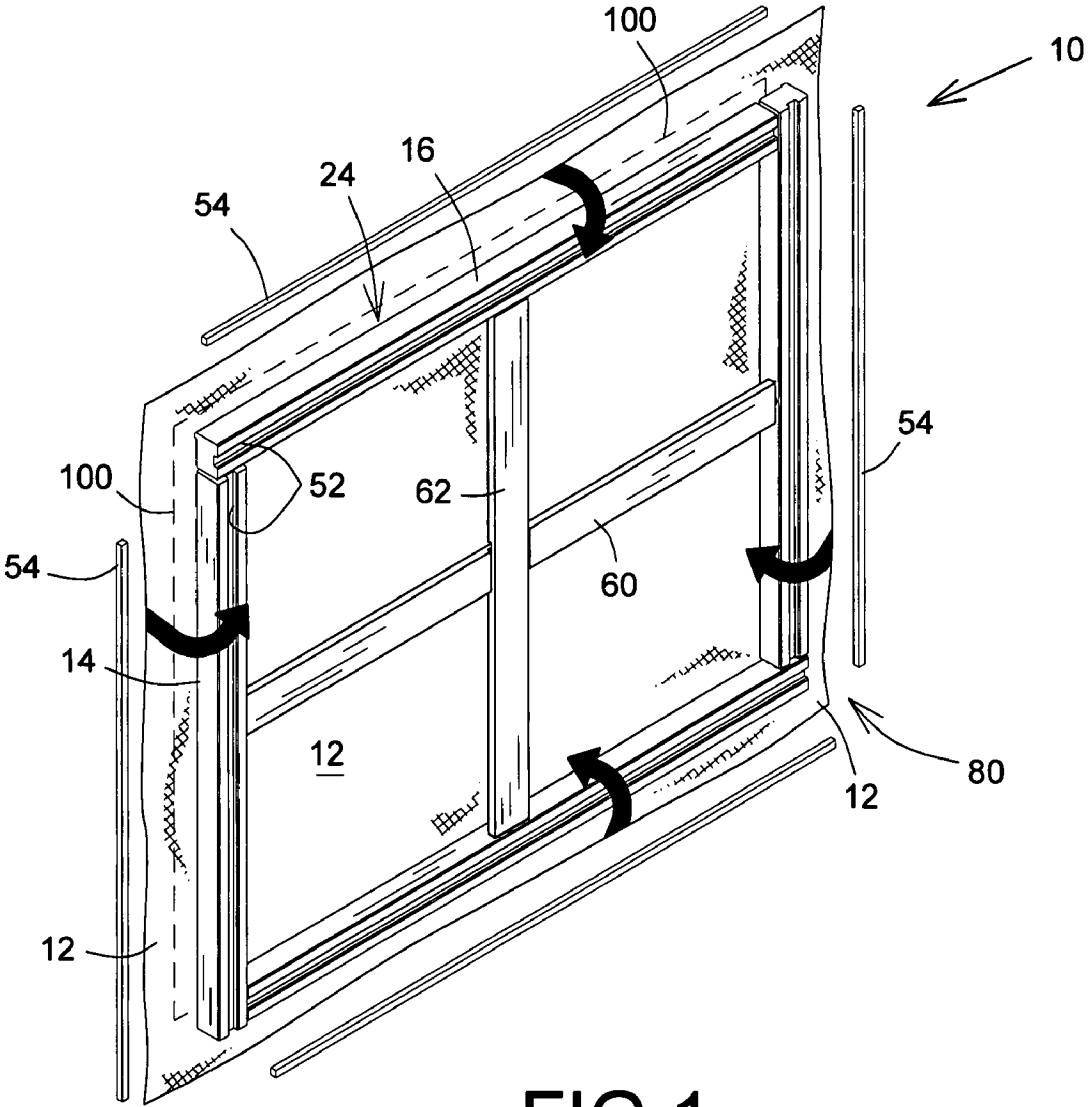
FIG. 1 is a partially exploded rear perspective view of an adjustable stretching assembly for a stretching a canvas, prior to connection of the canvas thereto, in accordance with an embodiment of the present invention.

Reference is now made to FIGS. 1, 1*a*, 2, 3, 4, and 4*a*. In FIG. 1, there is schematically shown an embodiment of an adjustable canvas stretching assembly, shown generally as 10 for attachment and stretching, in an assembled end-to-end configuration 80, of a canvas 12 thereupon to a desired tightness. As shown best in FIG. 2, the assembly 10 consists of, preferably identical, first and second elongate members or stretching bars 14 and, also preferably identical, third and fourth elongate members or stretching bars 16. All of the stretching bars 14, 16 are rectangular hexahedrons in shape, having inner and outer faces 18, 20 and adjacent rear and front faces 22, 24 extending adjacently therebetween, the inner and outer faces 18, 20 and rear and front faces 22, 24 extending longitudinally from a first end face 26 to a second end face 28 of each stretching bar 14, 16. The first and second stretching bars 14 are of an identical first length between the respective end faces 26, 28 thereof, whereas the third and fourth stretching bars 16 are of an identical second length between their respective end faces 26, 28. It should be noted, however, that the first and second lengths may also be the same, notably where the assembly 10 is intended for stretching an essentially square canvas.

As shown in FIGS. 2, 3, 4, and 4*a*, each first end face 26 has at least one axial end bore or channel 30 extending axially from the first end face 26 inwardly into the stretching bar 14, 16 along an axis X defined by the stretching bar 14, 16, i.e. generally parallel faces 18, 20, 22, 24 and perpendicular to the end faces 26, 28. Each first end face 28 also has an adjustable threaded bolt 32 mounted thereon, preferably in a threaded socket 34 extending axially into the stretching bar 14, 16. The bolt 32 is axially adjustable back and forth along the axis X by rotation thereof to move a head 36 of the bolt 32 away from or towards the first end face 26. Similarly, each inner face 18 has, adjacent the respective second end face 28, at least one inner channel 38 extending inwardly into the stretching bar 14, 16 from the inner face 18 and generally perpendicular the axis X, i.e. perpendicular to the inner face 18.

The end channels 30 and inner channels 38 are positioned such that a connector member 40, as a dowel pin or the like, may be snugly and grippingly inserted therein to connect the first end faces 26 and inner faces 18 of the first and second stretching bars 14 to, respectively, the inner faces 18 and first end faces 26 of the third and fourth stretching bars 16 to place the assembly 10, from a disassembled configuration 82, into an assembled configuration 80. Specifically, for the assembled configuration 80, each connector member 40 is inserted, on a first connector end 42 thereof into an end channel 30 of first or second stretching bar 14 and into an, on an opposite second connector end 42 thereof, into an inner channel 38. Further, the channels 30, 38 and connector members 40 are sized and, preferably cylindrically, shaped such that the connector members 40 fit snuggly into the channels 30, 38 and that connected adjacent stretching bars 14, 16 may be pushed towards one another until the inner face 18 of each stretching bar 14, 16 abuts against the head 36 of bolt 32 of the connected adjacent stretching bar 14, 16 and the head 36 abutting against the first end face 26.

The channels 30, 38 are further positioned such that when the stretching bars 14, 16 are connected by connector members 40 in assembled configuration 80, the second end face 28 of each stretching bar 14, 16 is in planar registration with the outer face 20 of the connected adjacent stretching bar 14, 16. Thus, in the assembled configuration 80, the stretching bars 14, 16 are connected together, with the front faces 24 defining a front side 24 of the assembly 10 and the rear faces 22 defining a rear side 22 of the assembly. Preferably, to provide enhanced stability and prevent any rotation of the stretching bars 14, 16 about respective connector members 40, there are two end channels 30 on each first end face 26 and two corresponding inner channels 38 on each inner face 18, thus ensuring that each stretching bar 14, 16 is connected by two connector members 40. Preferably, the channels 30, 38 are positioned diagonally opposite one another, thus ensuring that the stretching bars 14, 16 are connected to one another proximal both the rear face 22 and front face 24. The bolt 32 and bolt socket 34 are situated proximal the rear face 22 to ensure that the bolt may be turned and accessed from the rear face 22 when the canvas is connected to the assembly 10.

Figure 4A:
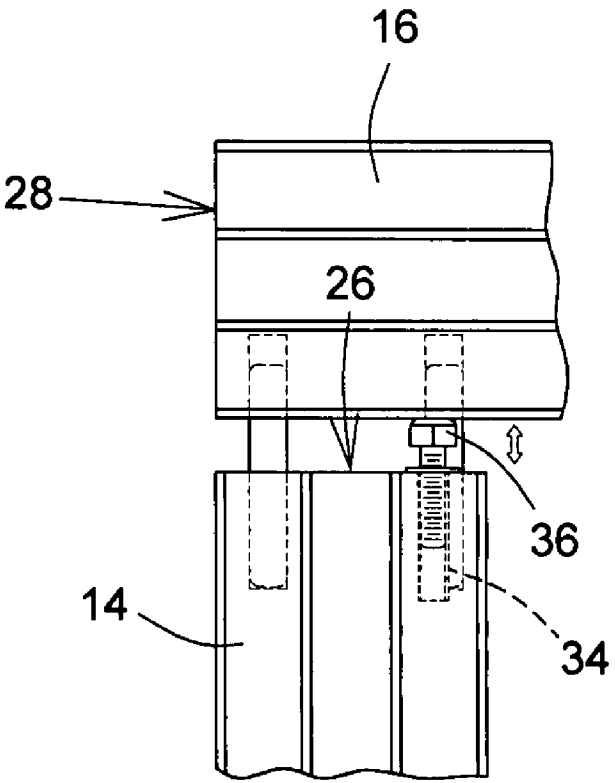
FIG. 4*a* is a partial enlarged rear plan view showing adjacent stretching bars of the assembly of FIG. 1 with the stretching bars extended.
Figure 4:
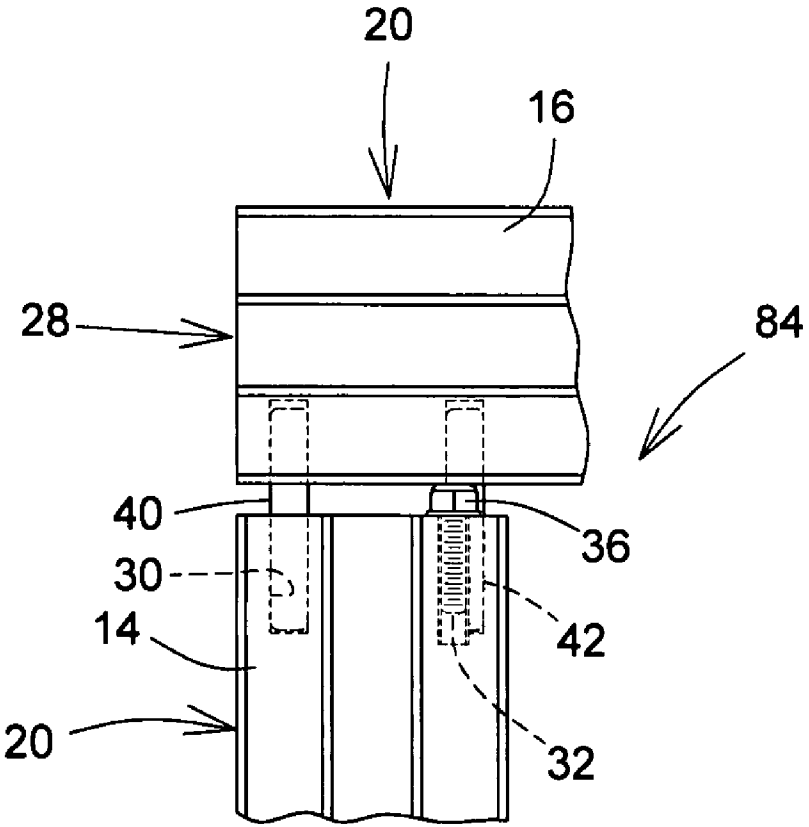
FIG. 4 is a partial enlarged rear plan view showing adjacent stretching bars of the assembly of FIG. 1 with the stretching bars retracted.

As best shown in FIGS. 4 and 4*a*, once connected, each stretching bar 14, 16, on the first end face 26 thereof, can be moved away from an adjacent connected stretching bar 14, 16, by rotating the head 36 in a first direction, for example with a wrench or the like (not shown). Conversely, if it is desired to decrease the space between two adjacent stretching bars 14, 16, when the inner face 18 of one stretching bar 14, 16 is abutting the head 36, one has only to rotate the bolt in a second direction to move the head 36 closer to the first end face 26 and to push the stretching bars 14, 16 towards one another until the inner face 18 again abuts the head 18. Thus, the bolts 32 provide adjustable spacing of the stretching bars 14, 16 for adjustable stretching of the canvas when connected to the assembly 10.

Turning now to the method of using the assembly 10, when it is desired to stretch a canvas 12 with the assembly 10, the assembly 10 is placed in the assembled configuration 80, as described above. The canvas 12 is then connected to the rear face 22 of each stretching bar 14, 16, which together form the rear face 22 of the assembly 10. Preferably, however, the canvas 12 is connected to the assembly 10 in assembled configuration 80 with each of the stretching bars 14, 16 in a retracted configuration 84 in which the bolts 32 are fully retracted with the heads 36 abutting against the first end face 26 of their respective bars 14, 16 and with the inner face 18 of the adjacent bar 14, 16 abutting the head 36. By rotating the heads 36 in the first direction, the user may force the stretching bars 14, 16 to be extended away from one another by extension of the bolts 32 until the canvas 12 is stretched to a desired tightness, in the view of the user, across the front face 24 of the assembly 10, with a display portion 100, shown in dotted lines in FIG. 1, visible and stretched across the front side 24 of the frame 10. Typically, the display portion 100 contains the image inscribed on the canvas 10. Alternatively, if the user finds that the canvas 12 is stretched too tightly, the user may rotate one or more of the heads 36 in the second direction, thus enabling one or more of the stretching bars 14, 16 to be pushed inwardly towards another stretching bar 14, 16 to stretch the canvas 12 less tightly. Conveniently, as each stretching bar 14, 16 may be drawn away or moved closer toward an adjacent bar 14, 16, adjustment of the stretching when assembly 10 is assembled may be effected in any of the four axial directions of the stretching bars 14, 16. In order to minimize contact between the canvas 12 and front side 24 when the canvas 12 is stretched tightly thereacross, each stretching bar 14, 16 preferably has a ridge or lip 58 protruding outwardly from the front face 22, adjacent to and in planar registration with the outer face 20.

Figure 1A:
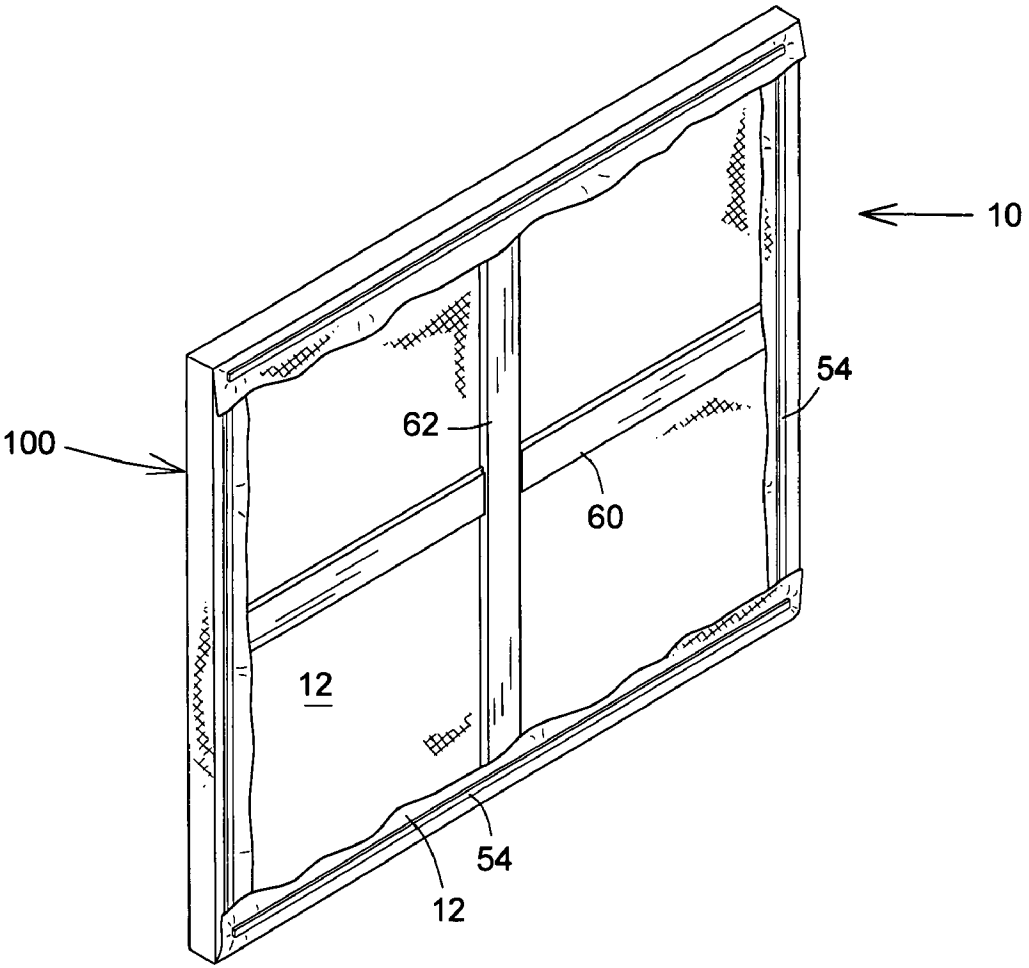
FIG. 1*a* is a rear perspective view of the assembly shown in FIG. 1, showing the canvas framed thereupon.

Referring now to FIGS. 1 and 1*a*, the canvas 12 may be connected, to the assembly 10 by connecting the canvas 12 to the rear face 22 of each stretching bar 14, 16 with any conventional connector, such as screws, tacks, staples, glue, or the like. However, to minimize the need to perforate the canvas 12, there is provided a slot 52 extending inwardly from the rear face 22 of each stretching bar 14, 16 and a corresponding slot member 54 for connecting the canvas 12 to the rear faces 22. The slot members 54 and slot 52 are sized and shaped, preferably rectangularly, for snug and retaining insertion of the slot member 54 into the slot 52 that typically extends axially between the first and second end faces 26, 28 of each stretching bar 14, 16. Thus, to connect the canvas 12 to the assembly 10, preferably in assembled configuration 80 with all bars 14, 16 in retracted configuration 82, the canvas 12 is draped across or seated into each slot 52. The respective slot member 54 is then pushed, or wedged, into the slot 52 on each stretching bar 14, 16 to grip the canvas 12 within the slot 52 and connect the canvas 12 to the assembly 10, minimizing need for nails, staples, or the like which perforate the canvas 12. The slots 52 and slot members 54, are further sized and shaped such that when the slot members 54 are inserted into the slots 52 with the canvas 12 held therebetween, the slot members 54 in slots 52 extend generally planarly in register with the rear faces 22.

Once the canvas 12 is connected to the assembly 10 and stretched to the desired tightness, as described above, the canvas 12 may be hung on a wall or other surface, typically with the rear face 22 connected to and facing the surface. Thus, the assembly 10 in assembled configuration may be used as a frame base 10 for hanging the canvas 12. Additionally, if desired, decorative mouldings may be connected to the stretching bars 14, 16, once the canvas 12 is connected thereto and stretched, to provide a decorative frame for the canvas 12.

Figure 2:
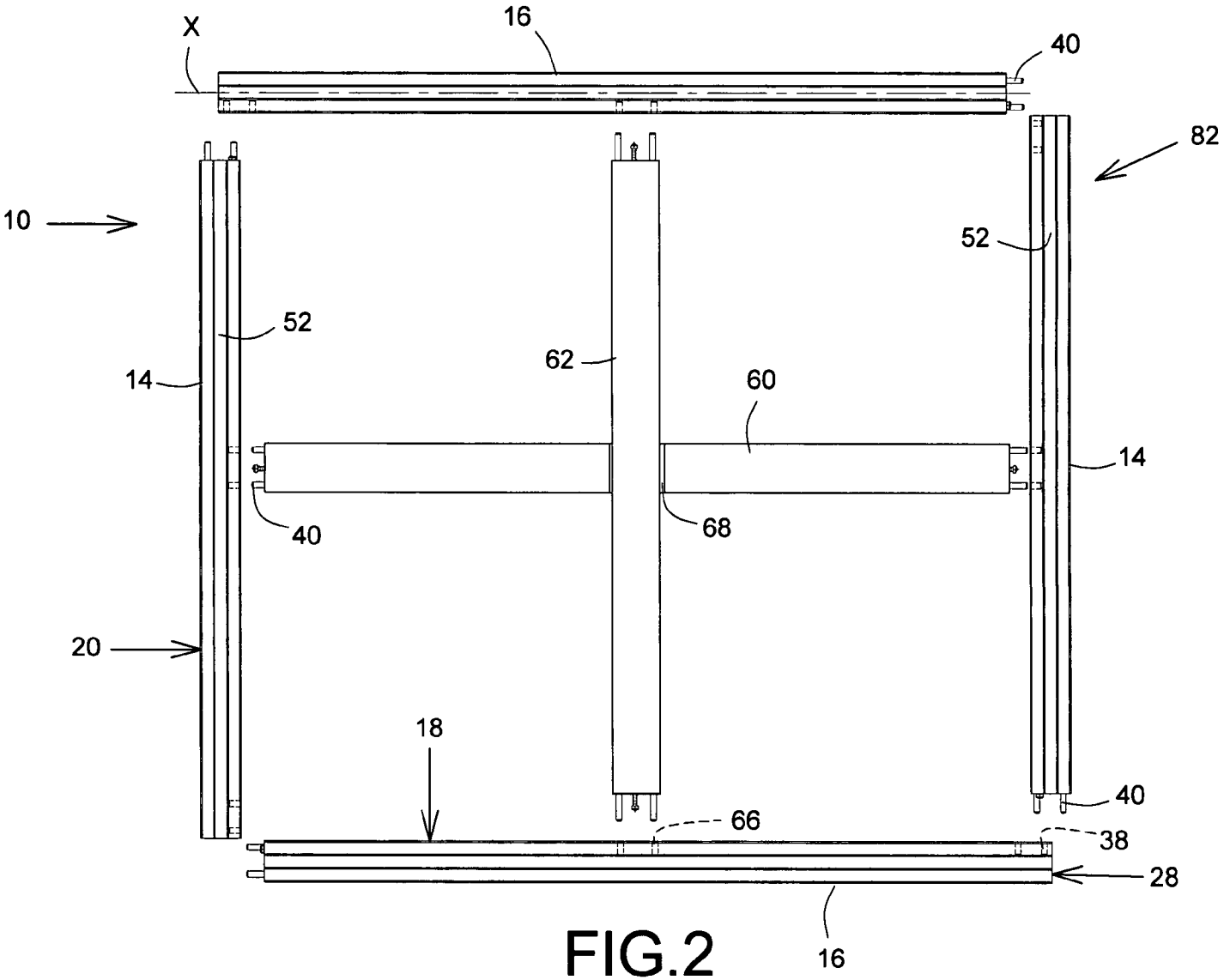
FIG. 2 is an exploded rear plan view of the assembly shown in FIG. 1.
Figure 3:
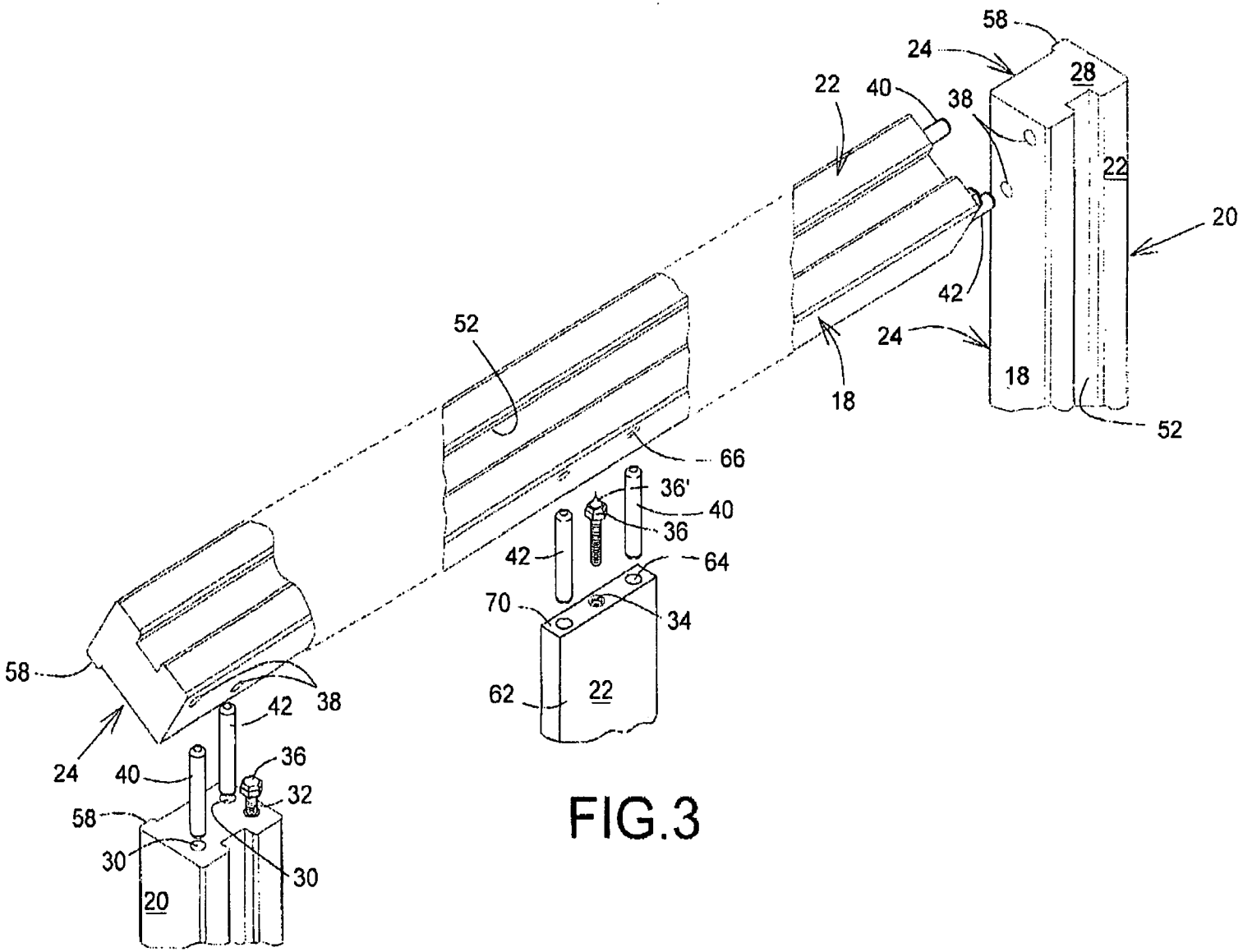
FIG. 3 is a partial exploded perspective view of the assembly shown in FIG. 1.

Reference is now made to FIGS. 1, 2, and 3. Optionally, for larger canvases 12 and longer stretching bars 14, 16, the assembly 10 may have additional elongate first and second cross members or bars 60, 62 which are connectable, respectively, to the first and second stretching bars 14 and the third and fourth stretching bars 16 in the assembled configuration 80. The first cross bar 60 is substantially equal in length to the third and fourth stretching bars 16, and more specifically generally equal to the distance between the first and second stretching bars 14, and the second cross bar 62 is substantially equal in length to first length of the first and second stretching bars 14, and more specifically generally equal to the distance between the third and fourth stretching bars 16. Each cross bar 60, 62 has at least one, and preferably two, cross bar channels 64 at opposed cross bar ends 70 and extending generally axially therein, with each stretching bar 14, 16 having corresponding frame cross bar channels 66 positioned generally centrally thereupon and extending inwardly from the corresponding inner face 18 thereof and generally perpendicularly from the axis X thereof. Thus, as the assembly 10 is assembled the cross bars 60, 62 may be connected to the stretching bars 10 using connector members 40 in channels 64, 66 in the same fashion as for connector members 40 in channels 30, 38. As the cross bar channels 66 are disposed generally centrally on the stretching bars 14, 16 the cross bars 60, 62 generally extend across the center of the assembly 10 when assembled. Each of the cross bars 62, 64 has a centrally situated recess 68, well known in the art, which brace the cross bars 62, 64 at their intersection. Optionally, there may also be a bolt 32 and bolt socket 34 at each cross bar end 70, which may be used when adjusting the frame 10 in the same fashion as for stretching bars 14, 16. Further, to provide greater stability of the cross bars 62, 64 and alignment, the bolt 32 for the cross bars 62, 64 may have a perforating protrusion 102, for example a pointed stud 36' or the like, extending axially from the head 36 of the bolt 32 for perforating the stretching bars 14, 16 as the bolt 32 is extended.

The stretching bars 14, 16 and cross bars 60, 62 are preferably constructed of wood, although other materials, such as plastic may be envisaged. The connector members 40, bolt 32, and bolt socket 34 are preferably constructed of metal. However, once again, alternative materials, such as rigid plastics, may be deployed. Further, while channels 30, 38, 64, 66 and connector members 40 are preferably cylindrical, any shape and size that allows for snug and gripping retention of connector members 40 in channels 30, 38, 64, 66 may be deployed.

Although the present frame assembly has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. An adjustable canvas stretching assembly for stretching a canvas, the stretching assembly comprising:

first, second, third, and fourth elongate stretching bars of generally rectangular hexahedron shape having, extending longitudinally from respective first end faces to opposed respective second end faces, opposed respective outer and inner faces extending adjacently between generally opposed rear and front faces, each first end face having at least one end channel extending axially from the first end face inwardly into the stretching bar along an axis defined by the stretching bar and an adjustable bolt disposed thereon and axially adjustable rear and forth along the axis by rotation of the bolt, each inner face having at least one inner channel extending inwardly into the stretching bar from the inner face and generally perpendicular the axis adjacent the respective second end face, the first and second stretching bars being of a first length and the third and fourth stretching bars being of a second length; and a plurality of connector members, each connector member being snugly insertable into an inner channel of one stretching bar and into the end channel of an adjacent stretching bar to connect, in an assembled configuration for the assembly, the first and second stretching bars generally perpendicularly to the third and fourth stretching bars with each first end face of each stretching bar connected to the inner face of an adjacent stretching bar and abutting against a head of the bolt, with the front bar faces defining a front side of the assembly and the rear faces defining a rear side of the assembly for attachment of the canvas thereto, the end channels and inner channels being positioned for registration of the second end face of each stretching bar with the outer face of an adjacent stretching bar connected thereto, wherein the stretching bars may be drawn away from one another when connected by rotating the bolts to stretch the canvas tightly across the front side of the assembly.

2. The assembly of claim 1, wherein the first and second lengths are substantially equal to one another.

3. The assembly of claim 1, wherein each first end face has two end channels and each inner face has two corresponding inner channels.

4. The assembly of claim 1, wherein each rear face has a slot extending inwardly therefrom and oriented generally axially therealong, and, for each stretching bar, the assembly includes a corresponding slot member, each slot and corresponding slot member being sized and shaped for snug and retaining insertion of the corresponding slot member into the slot, for gripping the canvas therebetween.

5. The assembly of claim 4, wherein each slot extends axially between the first and second end faces of the corresponding stretching bar.

6. The assembly of claim 1, further including an elongate cross bar extending between the first and second stretching bars and having a length substantially equal to the second length, the cross bar having at least one cross bar channel extending generally axially therein at each one of opposed cross bar ends and connector members, each connector member being snugly insertable into a corresponding one of the cross bar channel and into a corresponding frame cross bar channel extending inwardly from the inner face of a corresponding one of the first and second stretching bars and being disposed generally centrally thereupon to connect, in the assembled configuration, the cross bar generally perpendicularly to the first and second stretching bars.

7. The assembly of claim 6, wherein each one of the cross bar end includes a corresponding adjustable cross bar bolt disposed thereon and axially adjustable rear and forth along a cross bar axis by rotation of the cross bar bolt, in the assembled configuration, the cross bar connecting to the first and second stretching bars with the inner face of each one of the first and second stretching bars connecting to a corresponding cross bar end and abutting against a head of the cross bar bolt.

8. The assembly of claim 7, wherein the cross bar is a first cross bar, and the assembly further includes a second elongate cross bar extending between the third and fourth stretching bars and having a length substantially equal to the first length, the second cross bar having at least one cross bar channel extending generally axially therein at each one of opposed cross bar ends and connector members, each connector member being snugly insertable into a corresponding one of the cross bar channel and into a corresponding frame cross bar channel extending inwardly from the inner face of a corresponding one of the third and fourth stretching bars and being disposed generally centrally thereupon to connect, in the assembled configuration, the second cross bar generally perpendicularly to the third and fourth stretching bars.

9. The assembly of claim 8, wherein each one of the second cross bar end includes a corresponding adjustable cross bar bolt disposed thereon and axially adjustable rear and forth along a cross bar axis by rotation of the cross bar bolt, in the assembled configuration, the second cross bar connecting to the third and fourth stretching bars with the inner face of each one of the third and fourth stretching bars connecting to a corresponding second cross bar end and abutting against a head of the cross bar bolt.

10. The assembly of claim 9, wherein each one of the first and second cross bars has a generally centrally recess formed thereon for receiving an intersecting section of the other one of the first and second cross bars at an intersection thereof when in the assembled configuration.

11. The assembly of claim 9, wherein each one of the cross bar bolt has a perforating protrusion extending axially from the head of the cross bar bolt.

* * * * *